US006447178B2

(12) United States Patent
Thering et al.

(10) Patent No.: US 6,447,178 B2
(45) Date of Patent: Sep. 10, 2002

(54) SYSTEM, METHOD, AND APPARATUS FOR PROVIDING MULTIPLE EXTRUSION WIDTHS

(75) Inventors: Michael R. Thering; Joseph B. Gault, both of Austin, TX (US); John Straigis, Stanford, CA (US); Matthew R. Thomas; William C. May, both of Austin, TX (US)

(73) Assignee: Applied Science Fiction, Inc., Austin, TX (US)

( * ) Notice: Subject to any disclaimer, the term of this patent is extended or adjusted under 35 U.S.C. 154(b) by 0 days.

(21) Appl. No.: 09/752,155

(22) Filed: Dec. 29, 2000

Related U.S. Application Data

(60) Provisional application No. 60/234,808, filed on Sep. 22, 2000, and provisional application No. 60/174,028, filed on Dec. 30, 1999.

(51) Int. Cl.[7] ..... G03D 5/00

(52) U.S. Cl. ..... 396/604; 118/300; 118/256

(58) Field of Search ..... 396/604, 605, 396/627, 626, 636; 355/27–29; 118/300, 325

(56) References Cited

U.S. PATENT DOCUMENTS

| | | | | |
|---|---|---|---|---|
| 2,404,138 A | 7/1946 | Mayer | ..... | 95/94 |
| 3,520,689 A | 7/1970 | Nagae et al. | ..... | 96/55 |
| 3,520,690 A | 7/1970 | Nagae et al. | ..... | 96/55 |
| 3,587,435 A | 6/1971 | Chioffe | ..... | 95/89 |

(List continued on next page.)

FOREIGN PATENT DOCUMENTS

| | | | | |
|---|---|---|---|---|
| EP | 0 261 782 A2 | 8/1987 | ..... | H04N/1/46 |
| EP | 0 422 220 A1 | 3/1989 | ..... | A61B/6/03 |

(List continued on next page.)

OTHER PUBLICATIONS

"Adaptive Fourier Threshold Filtering: A Method to Reduce Noise and Incoherent Artifacts in High Resolution Cardiac Images", Doyle, M., et al., 8306 Magnetic Resonance in Medicine 31, No. 5, Baltimore, MD, May, pp. 546–550, 1994.

"Anisotropic Spectral Magnitude Estimation Filters for Noise Reduction and Image Enhancement", Aich, T., et al., Philips GmbH Research Laboratories, IEEE, pp. 335–338, 1996.

(List continued on next page.)

*Primary Examiner*—D. Rutledge
(74) *Attorney, Agent, or Firm*—Simon, Galasso & Frantz PLC; Raymond M. Galasso; Edward J. Marshall

(57) ABSTRACT

Multiple widths of fluid may be extruded onto portions of material without requiring a complex reconfiguration of the system or replacing the extruding device. In at least one embodiment, various extrusion widths are provided by altering the angle at which materials are guided with respect to the extruding device along a lateral plane with the extruder. In one embodiment, the present invention provides for the manipulation of the position of the extruding device with respect to the material, or alternately, by manipulation of the position of the material with respect to the extruding device. Another embodiment provides a single extruder with multiple applicator heads of different sizes. An additional embodiment provides a single coater head with multiple applicator openings of different sizes. Yet another embodiment provides an extruding device capable of moving laterally over the material to achieve the proper angle of approach. The preferred embodiment of the invention involves developing multiple film sizes; in particular, applying a first extrusion width on C135 film and applying a second extrusion width on APS film; however, the invention can be applied to applying fluids on multiple film and/or material configurations.

45 Claims, 9 Drawing Sheets

U.S. PATENT DOCUMENTS

| | | | | |
|---|---|---|---|---|
| 3,615,479 | A | 10/1971 | Kohler et al. | 96/48 |
| 3,615,498 | A | 10/1971 | Aral | 96/55 |
| 3,617,282 | A | 11/1971 | Bard | 96/59 |
| 3,747,120 | A | 7/1973 | Stemme | 346/75 |
| 3,903,541 | A | 9/1975 | Von Meister et al. | 354/317 |
| 3,946,398 | A | 3/1976 | Kyser et al. | 346/1 |
| 3,959,048 | A | 5/1976 | Stanfield et al. | 156/94 |
| 4,026,756 | A | 5/1977 | Stanfield et al. | 156/554 |
| 4,081,577 | A | 3/1978 | Horner | 427/424 |
| 4,142,107 | A | 2/1979 | Hatzakis et al. | 250/571 |
| 4,215,927 | A | 8/1980 | Grant et al. | 354/317 |
| 4,249,985 | A | 2/1981 | Stanfield | 156/554 |
| 4,301,469 | A | 11/1981 | Modeen et al. | 358/75 |
| 4,490,729 | A | 12/1984 | Clark et al. | 346/75 |
| 4,501,480 | A | 2/1985 | Matsui et al. | 354/298 |
| 4,564,280 | A | 1/1986 | Fukuda | 354/317 |
| 4,594,598 | A | 6/1986 | Iwagami | 346/140 |
| 4,621,037 | A | 11/1986 | Kanda et al. | 430/30 |
| 4,623,236 | A | 11/1986 | Stella | 354/318 |
| 4,636,808 | A | 1/1987 | Herron | 346/75 |
| 4,666,307 | A | 5/1987 | Matsumoto et al. | 356/404 |
| 4,670,779 | A | 6/1987 | Nagano | 358/75 |
| 4,736,221 | A | 4/1988 | Shidara | 354/317 |
| 4,745,040 | A | 5/1988 | Levine | 430/21 |
| 4,755,844 | A | 7/1988 | Tsuchiya et al. | 354/317 |
| 4,777,102 | A | 10/1988 | Levine | 430/21 |
| 4,796,061 | A | 1/1989 | Ikeda et al. | 355/73 |
| 4,814,630 | A | 3/1989 | Lim | 250/578 |
| 4,821,114 | A | 4/1989 | Gebhardt | 358/75 |
| 4,845,551 | A | 7/1989 | Matsumoto | 358/80 |
| 4,851,311 | A | 7/1989 | Millis et al. | 430/30 |
| 4,857,430 | A | 8/1989 | Millis et al. | 430/30 |
| 4,875,067 | A | 10/1989 | Kanazaki et al. | 354/325 |
| 4,969,045 | A | 11/1990 | Haruki et al. | 358/228 |
| 4,994,918 | A | 2/1991 | Lingemann | 358/214 |
| 5,034,767 | A | 7/1991 | Netz et al. | 354/317 |
| 5,101,286 | A | 3/1992 | Patton | 358/487 |
| 5,124,216 | A | 6/1992 | Giapis et al. | 430/30 |
| 5,155,596 | A | 10/1992 | Kurtz et al. | 358/214 |
| 5,196,285 | A | 3/1993 | Thomson | 430/30 |
| 5,212,512 | A | 5/1993 | Shiota | 354/319 |
| 5,231,439 | A | 7/1993 | Takahashi et al. | 354/313 |
| 5,235,352 | A | 8/1993 | Pies et al. | 346/140 |
| 5,255,408 | A | 10/1993 | Blackman | 15/308 |
| 5,266,805 | A | 11/1993 | Edgar | 250/330 |
| 5,267,030 | A | 11/1993 | Giorgianni et al. | 358/527 |
| 5,292,605 | A | 3/1994 | Thomson | 430/30 |
| 5,296,923 | A | 3/1994 | Hung | 358/527 |
| 5,350,651 | A | 9/1994 | Evans et al. | 430/21 |
| 5,350,664 | A | 9/1994 | Simons | 430/362 |
| 5,357,307 | A | 10/1994 | Glanville et al. | 354/324 |
| 5,360,701 | A | 11/1994 | Elton et al. | 430/501 |
| 5,371,542 | A | 12/1994 | Pauli et al. | 348/262 |
| 5,391,443 | A | 2/1995 | Simons et al. | 430/21 |
| 5,414,779 | A | 5/1995 | Mitch | 382/199 |
| 5,416,550 | A | 5/1995 | Skye et al. | 354/298 |
| 5,418,119 | A | 5/1995 | Simons | 430/507 |
| 5,418,597 | A | 5/1995 | Lahcanski et al. | 355/76 |
| 5,432,579 | A | 7/1995 | Tokuda | 354/293 |
| 5,436,738 | A | 7/1995 | Manico | 358/503 |
| 5,440,365 | A | 8/1995 | Gates et al. | 354/298 |
| 5,447,811 | A | 9/1995 | Buhr et al. | 430/20 |
| 5,448,380 | A | 9/1995 | Park | 358/520 |
| 5,452,018 | A | 9/1995 | Capitant et al. | 348/651 |
| 5,465,155 | A | 11/1995 | Edgar | 358/500 |
| 5,496,669 | A | 3/1996 | Pforr et al. | 430/22 |
| 5,516,608 | A | 5/1996 | Hobbs et al. | 430/30 |
| 5,519,510 | A | 5/1996 | Edgar | 358/471 |
| 5,546,477 | A | 8/1996 | Knowles et al. | 382/242 |
| 5,550,566 | A | 8/1996 | Hodgson et al. | 345/202 |
| 5,552,904 | A | 9/1996 | Ryoo et al. | 358/518 |
| 5,563,717 | A | 10/1996 | Koeng et al. | 358/406 |
| 5,568,270 | A | 10/1996 | Endo | 358/298 |
| 5,576,836 | A | 11/1996 | Sano et al. | 358/302 |
| 5,581,376 | A | 12/1996 | Harrington | 358/518 |
| 5,596,415 | A | 1/1997 | Cosgrove et al. | 358/296 |
| 5,627,016 | A | 5/1997 | Manico | 430/434 |
| 5,664,253 | A | 9/1997 | Meyers | 396/603 |
| 5,664,255 | A | 9/1997 | Wen | 396/627 |
| 5,667,944 | A | 9/1997 | Reem et al. | 430/359 |
| 5,678,116 | A | 10/1997 | Sugimoto et al. | 396/611 |
| 5,691,118 | A | 11/1997 | Haye | 430/357 |
| 5,695,914 | A | 12/1997 | Simon et al. | 430/379 |
| 5,698,382 | A | 12/1997 | Nakahanada et al. | 430/418 |
| 5,726,773 | A | 3/1998 | Mehlo et al. | 358/474 |
| 5,739,897 | A | 4/1998 | Frick et al. | 355/40 |
| 5,771,107 | A | 6/1998 | Fujimoto et al. | 358/464 |
| 5,790,277 | A | 8/1998 | Edgar | 358/487 |
| 5,835,811 | A | 11/1998 | Tsumura | 396/598 |
| 5,870,172 | A | 2/1999 | Blume | 355/27 |
| 5,880,819 | A | 3/1999 | Tanaka et al. | 355/75 |
| 5,892,595 | A | 4/1999 | Yamakawa et al. | 358/530 |
| 5,930,388 | A | 7/1999 | Murakami et al. | 382/167 |
| 5,963,662 | A | 10/1999 | Vachtsevanos et al. | 382/150 |
| 5,966,465 | A | 10/1999 | Keith et al. | 382/232 |
| 5,979,011 | A | 11/1999 | Miyawaki et al. | 15/308 |
| 5,982,936 | A | 11/1999 | Tucker et al. | 382/233 |
| 5,982,937 | A | 11/1999 | Accad | 382/239 |
| 5,982,941 | A | 11/1999 | Loveridge et al. | 382/260 |
| 5,982,951 | A | 11/1999 | Katayama et al. | 382/284 |
| 5,988,896 | A * | 11/1999 | Edgar | 396/604 |
| 5,991,444 | A | 11/1999 | Burt et al. | 382/232 |
| 5,998,109 | A | 12/1999 | Hirabayashi | 430/434 |
| 6,000,284 | A | 12/1999 | Shin et al. | 73/150 |
| 6,005,987 | A | 12/1999 | Nakamura et al. | 382/294 |
| 6,065,824 | A | 5/2000 | Bullock et al. | 347/19 |
| 6,069,714 | A | 5/2000 | Edgar | 358/487 |
| 6,089,687 | A | 7/2000 | Helterline | 347/7 |
| 6,101,273 | A | 8/2000 | Matama | 382/169 |
| 6,102,508 | A | 8/2000 | Cowger | 347/7 |
| 6,117,236 | A * | 9/2000 | Ruschak et al. | 118/300 |
| 6,137,965 | A | 10/2000 | Burgeois et al. | 396/626 |

FOREIGN PATENT DOCUMENTS

| | | | |
|---|---|---|---|
| EP | 0 482 790 B1 | 9/1991 | H04N/1/40 |
| EP | 0 525 886 A3 | 7/1992 | G03D/5/00 |
| EP | 0 580 293 A1 | 6/1993 | H04N/1/04 |
| EP | 0 669 753 A2 | 2/1995 | H04N/1/407 |
| EP | 0 794 454 A2 | 2/1997 | G03B/27/73 |
| EP | 0 930 498 A2 | 12/1998 | G01N/21/88 |
| JP | 05-7809 * | 1/1993 | |
| JP | 08-38973 * | 2/1996 | |
| WO | WO 90/01240 | 2/1990 | H04N/1/40 |
| WO | WO 91/09493 | 6/1991 | H04N/5/217 |
| WO | WO 97/25652 | 7/1997 | G03D/5/00 |
| WO | WO 98/19216 | 5/1998 | G03C/5/29 |
| WO | WO 98/25399 | 6/1998 | H04N/1/38 |
| WO | WO 98/31142 | 7/1998 | H04N/5/253 |
| WO | WO 98/34157 | 8/1998 | |
| WO | WO 98/34397 | 8/1998 | |
| WO | WO 99/43148 | 8/1999 | H04N/1/00 |
| WO | WO 01/01197 | 1/2001 | G03D/5/00 |
| WO | WO 01/13174 A1 | 2/2001 | G03D/5/06 |

OTHER PUBLICATIONS

"Adaptive–neighborhood filtering of images of corrupted by signal–dependent noise", Rangayyan, R., et al., Applied Optics, vol. 37, No. 20, pp. 4477–4487, Jul. 10, 1998.

"Grayscale Characteristics", The Nature of Color Images, Photographic Negatives, pp. 163–168.

"Parallel Production of Oligonucleotides Arrays Using Membranes and Reagent Jet Printing", Stimpson, D., et al., Research Reports, BioTechniques, vol. 25, No. 5, pp. 886–890, 1998.

"Low–Cost Display Assembly and Interconnect Using Ink –Jet Printing Technology", Hayes, D. et al., Display Works '99, MicroFab Technologies, Inc., pp. 1–4, 1999.

"Ink–Jet Based Fluid Microdispensing in Biochemical Applications", Wallace, D., MicroFab Technologies, Inc., Laboratory Automation News, vol. 1, No. 5, pp. 6–9, Nov., 1996.

"Protorealistic Ink–Jet Printing Through Dynamic Spot Size Control", Wallace, D., Journal of Imaging Science and Technology, vol. 40, No. 5, pp. 390–395, Sep./Oct. 1996.

"MicroJet Printing of Solder and Polymers for Multi–Chip Modules and Chip–Scale Package", Hayes, D., et al., MicroFab Technologies, Inc.

"A Method of Characteristics Model of a Drop–on–Demand Ink–Jet Device Using an Integral Method Drop Formation Model", Wallace, D., MicroFab Technologies, Inc., The American Society of Mechanical Engineers, Winter Annual Meeting, pp. 1–9, Dec. 10–15, 1989.

"Digital Imaging Equipment White Papers", Putting Damaged Film on ICE, www.nikonusa.com/reference/whitepapers/imaging, Nikon Corporation, Nov. 28, 2000.

* cited by examiner-

SYSTEM, METHOD, AND APPARATUS FOR PROVIDING MULTIPLE EXTRUSION WIDTHS

CROSS REFERENCE TO RELATED APPLICATIONS

This application claims the benefit of U.S. Provisional Patent Application Ser. No. 60/174,028 filed Dec. 30, 1999 entitled "Method and Apparatus for Providing Multiple Extrusion Widths," of common assignee herewith. This application also claims the benefit of U.S. Provisional Patent Application Ser. No. 60/234,808 filed Sep. 22, 2000 entitled "System, Method, and Apparatus for Providing Multiple Extrusion Widths," of common assignee herewith.

FIELD OF THE INVENTION

The present invention relates generally to extrusion of fluids onto a material, and more particularly to providing a plurality of extrusion widths.

BACKGROUND OF THE INVENTION

In developing photographic film, a number of processing solutions or fluids are generally used to develop and stabilize an image on the photographic film. Automated equipment is frequently used to dispense these fluids, thereby improving the consistency of the development process, and reducing labor costs.

This automated equipment is usually configured to handle only one particular film size, so if a different size film must be processed, the equipment must be reconfigured to accommodate the new film size, or additional equipment must be maintained to process each unique film size separately.

Even in automated systems, some parts of the system will work only with a particular film size, and reconfiguring the equipment for use with a different film size most often requires an operator to substitute parts designed for one film size with parts constructed to work with a different film size. Some automated systems require parts with complex movement mechanisms to accommodate different film sizes. These complex mechanisms often require expensive drivers and equipment to control the movement. In general, the mechanisms also require that a substantial length of film be held over a flat, rigid surface, thereby increasing the chance of damaging the film. It would be advantageous if multiple film sizes could be handled without requiring complicated movement or replacement of parts.

SUMMARY OF THE INVENTION

Accordingly, the present invention provides an extruder for providing a plurality of extrusion widths. In one embodiment, the extruder comprises at least one coater head having a fluid entry opening capable of receiving an extrusion fluid, and at least one applicator opening capable of dispensing the extrusion fluid. The at least one coater head is capable of moving to a plurality of dispensing positions corresponding to the plurality of extrusion widths. Other embodiments provide an extruder comprising multiple coater heads and/or a coater head having multiple applicator openings of different sizes.

Another embodiment of the present invention provides an extrusion system comprising an extruder having a fluid entry opening capable of receiving an extrusion fluid and an applicator opening capable of dispensing the extrusion fluid, and at least one guide capable of guiding lengths of material having different widths along a predetermined path. The predetermined path, set by the at least one guide, includes at least a first point where a first length of material can be positioned at a first angle relative to the extruder's applicator opening. The predetermined path also has at least a second point where a second length of material can be positioned at a second angle, different from the first angle. The extruder is capable of being positioned proximate to the first point to dispense extrusion fluid across a desired width of the first length of material. The extruder is further capable of being positioned proximate to the at least second point to dispense extrusion fluid across a desired width of the second length of material. Other embodiments provide for an extrusion system, as described above, comprising a plurality of guides and/or having at least one guide as a roller.

Another embodiment provides for an extrusion system, as described above, further comprising a plurality of rollers. In this embodiment, the first roller of the plurality of rollers is capable of supporting the first length of material at the first point. The second roller of the plurality of rollers is capable of supporting the second length of material at the second point.

Another embodiment of the present invention provides another method for providing a plurality of extrusion widths. In one embodiment, the method comprises providing an extruder having a fluid entry opening capable of receiving an extrusion fluid and an applicator opening capable of dispensing the extrusion fluid. Furthermore, the method comprises guiding a first length of material along a predetermined path so that a portion of the first length of material is positioned at a first angle relative to the applicator opening. The method also comprises positioning the extruder proximate to a portion of the first length of material positioned at a first angle relative to the applicator opening and dispensing the extrusion fluid across a desired width of the first length of material. The method further comprises guiding a second length of material along a predetermined path, such that a portion of the second length of material is positioned at a second angle, different from the first angle, relative to the applicator opening. Furthermore, the method additionally comprises positioning the extruder proximate to the portion of the second length of material positioned at a second angle relative to the applicator opening and dispensing the extrusion fluid across a desired width of the second length of material.

Other embodiments include guiding lengths of material using a plurality of rollers, the first of the plurality of rollers capable of supporting at least a portion of the first length of material positioned at a first angle and a second of the plurality of rollers capable of supporting a portion of the second length of material positioned at the second angle. In one embodiment, the first of the plurality of rollers and the second of the plurality of rollers lie in a plane parallel to the applicator opening, and positioning the extruder includes moving the extruder laterally within the plane.

Furthermore, at least one embodiment of the present invention provides a film processing system comprising at least one illumination source, at least one light sensitive detector capable of generating electronic representations of images formed in a photographic film, and an extruder with a fluid entry opening capable of receiving an extrusion fluid and an applicator opening capable of dispensing the extrusion fluid. The film processing system further comprises a film transport system having at least one guide capable of guiding films having different widths along a predetermined path. The predetermined path set by the at least one guide has at least a first point at which film can be positioned at a first angle relative to the applicator opening. The predetermined path also has at least a second point at which a second film can be positioned at a second angle, different from the first angle. Furthermore, the predetermined path has at least a third point at which a film is capable of being positioned so that the at least one illumination source illuminates the film and at least one detector generates corresponding electronic images. The extruder is capable of being positioned proximate to the first point to dispense extrusion fluid across a desired width of the first film and proximate to the second point to dispense extrusion fluid across a desired width of the second film. Other embodiments provide film processing systems, as described above, comprising a plurality of guides.

Another embodiment provides a film processing system as described above, where the at least one illumination source is capable of providing infrared illumination along with the at least one detector which is sensitive to infrared illumination. Furthermore, the film transport system, the extruder, the at least one illumination source and the at least one detector cooperate to capture images at different times during a film's development.

An advantage of at least one embodiment of the present invention is that multiple film sizes may be processed using a single system without requiring an operator to manually reconfigure the system when film sizes are changed.

Another advantage of at least one embodiment of the present invention is that multiple extrusion widths may be produced from a single extruder.

An additional advantage of at least one embodiment of the present invention is that only a simple repositioning of the extruder is necessary to accommodate different film sizes. Another advantage of at least one embodiment of the present invention is that film being coated with extrusion fluid need not be kept on a rigid surface over a long distance, reducing the risk of damage to the film and ensuring even distribution of the developing fluid.

Yet another advantage of at least one embodiment of the present invention is that consumable costs and equipment costs can be reduced.

BRIEF DESCRIPTION OF THE DRAWING

Other objects, advantages, features and characteristics of the present invention, as well as methods, operation and functions of related elements of structure, and the combinations of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION OF THE INVENTION

FIGS. 1–14 illustrate a system, method, and apparatus for applying varying widths of fluids to materials. As described in greater detail below, by changing the angle at which a length of material, such as a photographic film, is moved past an extruder, the width of developer or other extruded fluid can be varied. Alternately, reorienting the extruder opening, or using an extruder with multiple coater heads with different applicator opening sizes, can vary the width of developer or other fluid extruded onto the film. In particular, the present invention is shown as part of a digital film processing system. The digital film processing system comprises an image capturing system for generating digital representations of images from a film record, and an image processing system for storage, processing and/or transmission of image information.

The following definitions are not intended to be limiting, but are provided to aid the reader in properly interpreting the following detailed description of the present invention. It will be appreciated that the terms defined herein may be eventually interpreted by a judge or jury, and that the exact meaning of the defined terms will evolve over time. The word "light," as used herein, refers to electromagnetic energy, and preferably electromagnetic energy with frequencies generally in the range of $10^{12}$ Hz to $10^{17}$ Hz, and includes visible light, which is generally in the range of $4\times10^{14}$ Hz to $7\times10^{14}$ Hz, as well as well as portions of the infrared (IR) and ultraviolet (UV) spectrum. The phrase "digital film processing" refers to the process of developing and electronically scanning film to create a digital representation of the images formed in the film. According to at least one embodiment of the present invention, during digital film processing, various views are taken of a single image formed in film using IR light. These views contain information from the multiple image layers in the film and include, but are not limited to, any combination of the following: a "front reflected view," in which the captured image is recorded using light that has been reflected off the front of the film; a "back reflected view," in which the captured image is recorded using light that has been reflected off the back of the film; a "front through view," in which the captured image is recorded using light that has been shined through the film from the front to the back; and a "back through view," in which the captured image is recorded using light that has been shined through the film from the back to the front. The term "processing system" refers to a combination of hardware and software that is used to manipulate electronic images captured from the aforementioned film to suit the preferences of the user.

Figure 1:
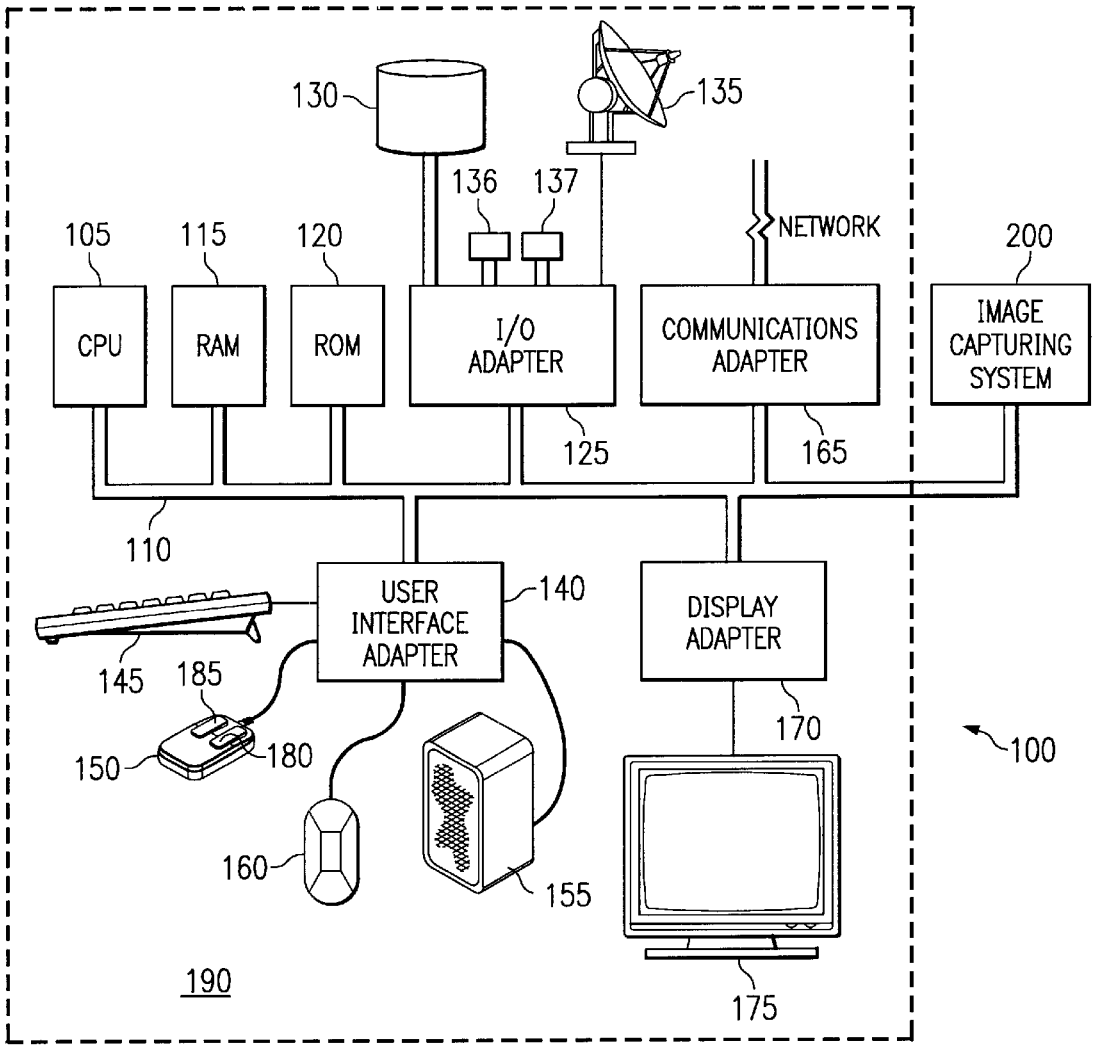
FIG. 1 is a block diagram of a digital film processing system including a processing system and an image capturing system according to at least one embodiment of the present invention.

Referring now to FIG. 1, a digital film processing system is depicted, and designated generally by reference numeral 100. The illustrated embodiment of digital film processing system 100 is comprised of processing system 190 and image capturing system 200. As illustrated, processing system 190 comprises a central processing unit 105, such as a conventional microprocessor, and a number of other units interconnected via at least one system bus 110. In one embodiment, processing system 190 and image capturing system 200 are separate systems interconnected for functionality. For example, processing system 190 may be a desktop computer, and image capturing system 200 may be a system similar to the one illustrated in FIG. 2. In this example, film processing system 200 is configured to depend upon a desktop computer for image processing and control functions. In another embodiment, processing system 190 and image capturing system 200 are part of a single physical unit.

One embodiment of processing system 190 is shown in FIG. 1. In this embodiment, processing system 190 is shown as an integral part of digital film processing system 100, and includes random access memory (RAM) 115, read-only memory (ROM) 120 wherein ROM 120 could also be erasable programmable read-only memory (EPROM) or electrically erasable programmable read-only memory (EEPROM), input/output (I/O) adapter 125 for connecting peripheral devices such as disk units 130, tape drives 135, CD recorders 136 or DVD recorders 137 to system bus 110, user interface adapter 140 for connecting keyboard 145, mouse 150, speaker 155, microphone 160, and/or other user interface devices to system bus 110, communications adapter 165 for connecting processing system 190 to an information network such as the Internet, and display adapter 170 connecting system bus 110 to a display device such as monitor 175. Mouse 150 has a series of buttons 180,185 and is used to control a cursor shown on monitor 175. It will be understood that processing system 190 may comprise other suitable data processing systems without departing from the scope of the present invention.

Figure 2:
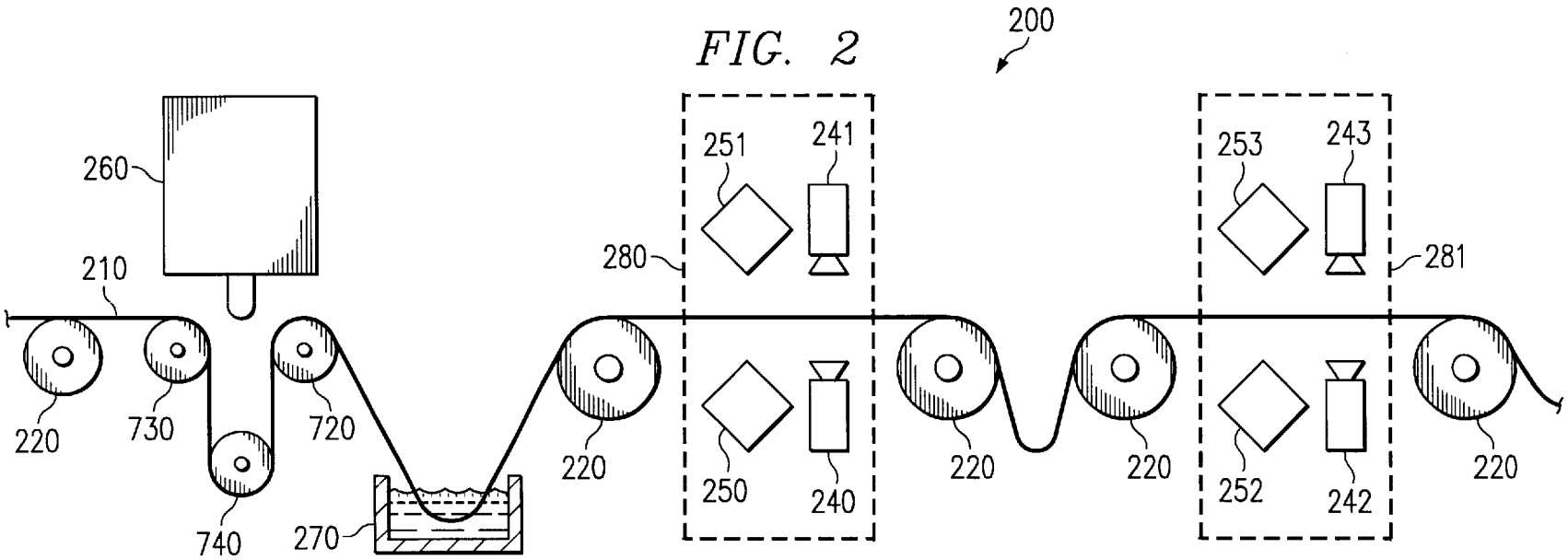
FIG. 2 is a diagram of an image capturing system according to at least one embodiment of the present invention.

Referring next to FIG. 2, a section of an image capturing system is depicted, and designated generally by reference numeral 200. In at least one embodiment, image capturing system 200 comprises film transport mechanisms such as pinch rollers 220 and web rollers 1320, 1330 and 1340, image recording devices such as cameras 240, 241, 242 and 243, IR illumination sources 250, 251, 252 and 253, and a chemical dispenser such as extruder assembly 260 and/or chemical bath 270. One group of illumination sources and corresponding detectors are referred to as an image capturing station. For example, IR illumination sources 250 and 251 combined with cameras 240 and 241, will be referred to as image capturing station 280; IR illumination sources 252 and 253, along with cameras 242 and 243 will be referred to as image capturing station 281. In the illustrated embodiment, station 281 is positioned further along the path of film 210 than image capturing station 280 in order to record images during a later stage of film development. Pinch rollers 220, extruder assembly 260 and image capturing stations 280 and 281 cooperate to develop film 210 and capture images, during and after the development process.

In operation, a film transport system, which may include pinch rollers 220, controls the movement and speed of film 210 through image capturing system 200 by gripping film 210 along the edge, thereby avoiding damage to the central portion of the film in which the image is formed. Other embodiments of a film transport system include leaders, metal bands, sprockets, edge tape, and web rollers 1320, 1330 and 1340. Leaders grab the beginning of film 210 and pull film 210 through image capturing system 200. Metal bands use tension and nibs to grab film 210 using perforations formed along the edge of film 210. Sprockets transport film 210 using toothed wheels that interface with the perforations in film 210 in a manner similar to the metal band systems. An edge tape transport system uses an adhesive tape to attach to the film for transport. A web, or vacuum back transport system, like rollers 1320, 1330 and 1340, may use an air suction device (not illustrated) to hold film 210 by the back to securely transport without touching the side of the film that has been applied developer. All of these types of transport systems, as well as other suitable film transport systems, may be used in implementing various embodiments of the present invention.

When placing film 210 at an angle to rollers 1320 and 1330, film 210 has a tendency to slide and "walk" along web roller 1320 or web roller 1330, instead of simply rolling. Film 210 sliding does not pose a problem; however, film 210 "walking" will move film 210 out of position, causing film 210 to be coated in the wrong area. To alleviate the problem of "walking", a film guide, such as guide rail 1325 shown in FIG. 13, can be used to hold film 210 in place when at an angle over roller 1320 or 1330. Other film guides may be used, including film tracks and guard rails. A film track could function as a tray for film 210, keeping film 210 in position before going over web roller 1320 or web roller 1330. Alternatively a guard rail may be placed on the surface of web roller 1320 or 1330 itself, keeping film 210 from "walking" out of position. If another transport system is used, as described above, other suitable film guides may be used to keep film 210 in place.

In the illustrated embodiment, pinch rollers 220 and web rollers 1320, 1330 and 1340 cooperate to move film 210 under extruder assembly 260 which applies a developing solution to film 210. Alternatively, other developer and chemical applicators could be used. Other applicators include, but are not limited to, aerosol applicators (not illustrated), chemical baths 270 and other slot coater configurations. These applicators can be used in place of, or in addition to extruder assembly 260 to apply developing solutions or other chemicals. In addition, various developing solutions and chemicals can be applied without departing from the scope of the current invention. Examples include C41 process chemicals, color monobath type solutions, black and white developing solutions, fixers, and the like. Images on film 210 can then be captured by image capture stations 280 and 281, which are preferably placed to scan the same image at different stages in the development process.

As described earlier in this text, image capturing station 280 comprises IR illumination sources 250 and 251, and cameras 240 and 241. In an embodiment of image capturing system 200 that is currently in use, IR illumination sources 250 and 251 are arrays of IR sources, such as light emitting diodes (LEDs), which are used in conjunction with IR detectors, such as cameras 240 and 241, to record electronic representations of images formed in film 210. Color photographic film is constructed using multiple film layers. Select layers have silver halide crystals combined with spectral sensitizers that make each silver halide layer sensitive to different image color information. In a basic color film, one layer (or group of layers) collects color information on each of the primary colors red, green and blue by converting the silver halide crystals in that layer to silver. IR illumination sources 250, 251 and cameras 240, 241 are positioned to capture views from light reflected off of and transmitted through the multiple image layers on film 210, from above and below film 210. This produces four separate views representing the developed silver image within the film layers: front reflected; back reflected; front through; and back through. Each of these views can be sent to processing system 190 to be processed in a manner described by FIG. 3. By using IR illumination, images from film 210 can be captured before film 210 has been fully developed without damaging film 210, by providing light to which the film layers are not sensitive. However, in addition to (or in place of) providing IR illumination, illumination sources 250 and 251 can provide full-spectrum illumination, monochromatic illumination, or white light illumination for use with red-green-blue (RGB) detectors.

Image capturing station 281 is configured essentially identically to image capturing station 280. Image capturing station 281 is positioned on film processing system 200 to provide four more views of the same image as station 280, except at a later time during the development process. Additional stations similar to image capturing stations 280 and 281 may be used without departing from the spirit and scope of the present invention. Alternatively, station 280 can be used alone, without station 281.

Image capturing system 200 can be configured to work with films of other sizes. For example, C135 film, described further in FIG. 4, may be developed using image capture system 200. Alternatively, image capturing system 200 can easily be configured to develop APS film, described further in FIG. 5. According to one embodiment, for image capturing system 200 to accommodate these different film types, extruder assembly 260 simply moves slot coater 1230 (shown in FIG. 12) over web roller 1330 or 1320, as described further in FIG. 13.

Although a particular digital film processing system is illustrated and described in FIGS. 1 and 2, those skilled in the art will appreciate that the present invention may be practiced using other suitable systems. For example, instead of employing extruder assembly 260 to extrude developer onto film 210, extruder assembly 260 can be used to extrude adhesive onto a strip of material. In another embodiment, extruder assembly 260 is used to deposit a liquid that dries or cures to form a magnetic strip, such as those used on the back of commercial credit cards. Yet another embodiment of the present invention contemplates a system which is a photolithography coater configured to accept semiconductor wafers of various sizes. Instead of pulling a strip of material through system 100, wafers are conveyed into a coating position using methods known to those in the semiconductor fabrication arts. extruder assembly 260 is then positioned over the wafer, and a width of photo-resist is extruded onto the wafer.

Figure 3:
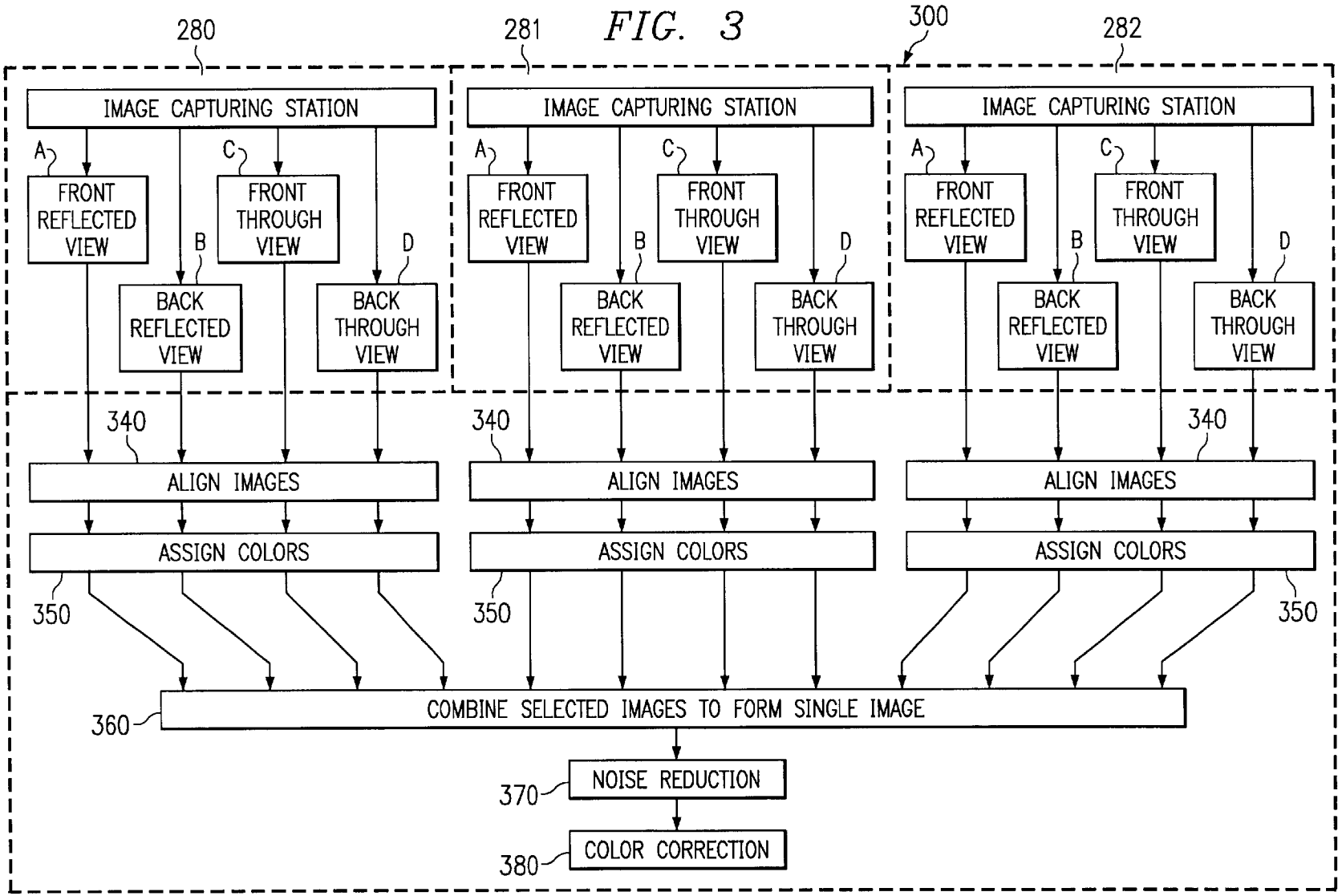
FIG. 3 is a flowchart illustrating a method, according to at least one embodiment of the present invention, for processing images delivered by the image capturing system illustrated in FIG. 2.

Referring now to FIG. 3, a flowchart illustrating a method for processing images delivered by the image capturing hardware is shown. To properly represent the images captured by image capturing system 200, processing system 190 manipulates and combines the views by employing one or more image processing algorithms, such as algorithm 300.

Image capturing station 280 is positioned to produce separate views of an image on film 210 early in the development process. These views include: a front reflected view A; a back reflected view B; a front through view C; and a back through view D. Image capturing station 281 produces the same views of the same image, except at different times during the development process of film 210. Here we will introduce a third image capturing station 282, similar to stations 280, and 281, except that station 282 is positioned to gather views of the same image after film 210 has completed its development. While the following method is implemented using three image capturing stations, the basic principles apply to any number of image capturing stations.

Preferably, each view A–D from each image capturing station, 280,281, and 282, is delivered to processing system 190. Views A–D from each station 280, 281, and 282, are processed by an alignment algorithm 340. This alignment allows the separate views A–D taken of the image to be compared. Each view A–D is preferably an IR representation of a different image layer or color channel developing on film 210. In order to form a representation of the original image, a different color is assigned to select views in step 350. In one embodiment, a red image, a blue image, and a green image are formed. The red image represents the content of the original image that is recorded in the layer of film sensitive to the red portion of the visible light spectrum. Similarly, the blue image represents the content recorded in the layer of film sensitive to the blue portion of the visible light spectrum and the green image represents the content recorded in the layer of film sensitive to the green portion of the visible light spectrum taken from the original image. The separate views A–D from each image capturing station 280,281, and 282 are then compared and combined in step 360 to form the single image originally represented by the multiple layers in film 210.

In at least one embodiment, noise reduction algorithms 370 and color correction algorithms 380 are used to improve the quality of the images. It will be appreciated that other filtering, defect correction, and similar algorithms may also be employed consistent with the objects of the present invention. Algorithms 370 and 380 employ techniques of digital image processing, many of which are known to those skilled in the art. It will be appreciated that various suitable techniques may be employed to implement noise reduction algorithm 370 and color correction algorithm 380 consistent with the present invention. The order in which the image processing algorithms 300 are performed is also not specific to the invention. FIG. 3 is not intended to be limiting, but is intended to provide one example of processing that may be performed to create a digital image.

Once an image has been processed by algorithms 300, the image is ready for delivery, as chosen by the user. The form in which the image may be delivered includes, but is not limited to, an electronic form, a photographic print, or a film record. Electronic outputs can be represented as a digital file, stored on mass storage devices such as disk unit 130, tape drive 135, CD recorder 136, or DVD recorder 137. Electronic outputs can also be transferred to other systems using communications adapter 165, where the file can be sent to the Internet, an intranet, as an e-mail, etc. The output can also be displayed as an image on a display such as monitor 175 or printed using a computer printer. The image can also be prepared for retrieval at an image processing kiosk which allows customers to recover their pictures and print them out in a form of their choosing without the assistance of a film development technician. Furthermore, the image can be represented on a form of film record, such as a film negative or positive image.

Figure 4:
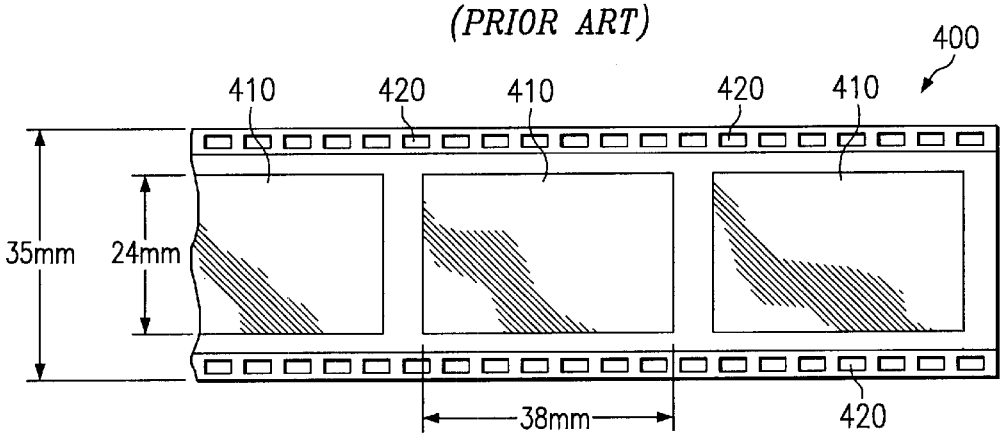
FIG. 4 (PRIOR ART)
FIG. 4 is a top view of C135 photographic film (prior art)

Referring next to FIG. 4, a section of C135 film is illustrated, and designated generally as item 400. C135 film, commonly known as 35 mm film, may be processed using digital film processing system 100 (FIG. 1). Each photograph taken with a 35 mm camera creates an exposed area 410 having a length of approximately 38 mm and a width of approximately 24 mm. Note also the sprocket holes 420 on the sides of the film. Sprocket holes 420 are used by most cameras to position C135 film 400. When C135 film 400 is developed, exposed areas 410 are the only areas that need to be coated with developing solution. Therefore, an ideal width of developing solution would be 24 mm, or just wide enough to cover the width of the exposed areas 410. If developer is not extruded in a wide enough path, then portions of the images recorded in exposed areas 410 would be improperly developed. Conversely, if the developer is deposited in a path that is too wide, the developing liquid can run through sprocket holes 420, and damage components of image capturing system 200. Even if the developer does not flow through holes 420, if the extrusion width is greater than necessary to develop exposed areas 410, developer is wasted, thus increasing the cost of developing C135 film 400.

Figure 5:
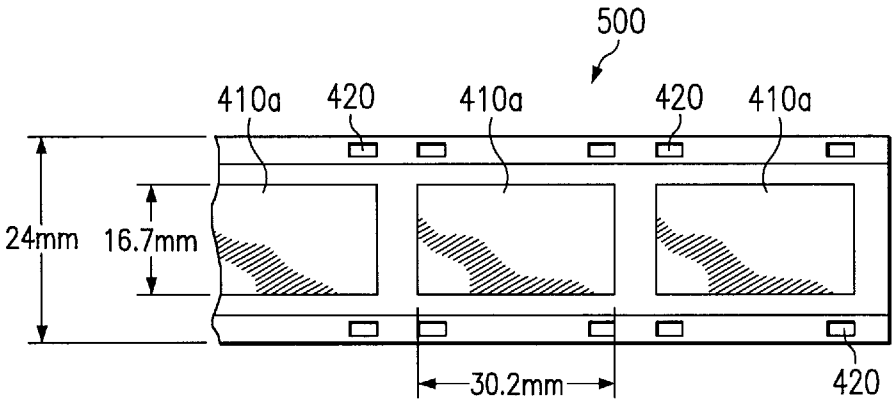
FIG. 5 (PRIOR ART)
FIG. 5 is a top view of APS photographic film (prior art)

Referring to FIG. 5, another film type is illustrated and designated generally by reference numeral 500. APS film 500 is used to record images in exposed areas 410*a*. APS film 500, like C135 film 400 (FIG. 4), also has sprocket holes 420. Two important differences between C135 film 400 and APS film 500 are the size of the exposed areas 410 and 410*a*, and the overall width of the films 400, 500. Exposed areas 410*a* are 30.2 mm long and only 16.7 mm wide, whereas one may recall that exposed areas 410 (FIG. 4) are 35 mm long and 24 mm wide. The entire strip of APS film 500 is only 24 mm wide. Since exposed areas 410*a* are narrower than exposed areas 410, the ideal extrusion width is correspondingly smaller. This difference in ideal developer extrusion width is one reason the two film types cannot be conventionally developed using the same system configuration. Consider, for instance, that a roll of C135 film 400 is developed (requiring a minimum extrusion width of approximately 24 mm) and a roll of APS film 500 is then processed using the same equipment configuration. If the extrusion width is not changed from 24 mm (the width required for developing 35 mm film), then developing fluid would most likely flow past the edges of APS film 500, possibly damaging equipment. At a minimum, more developer than necessary would be used, thus increasing processing costs.

Figure 6:
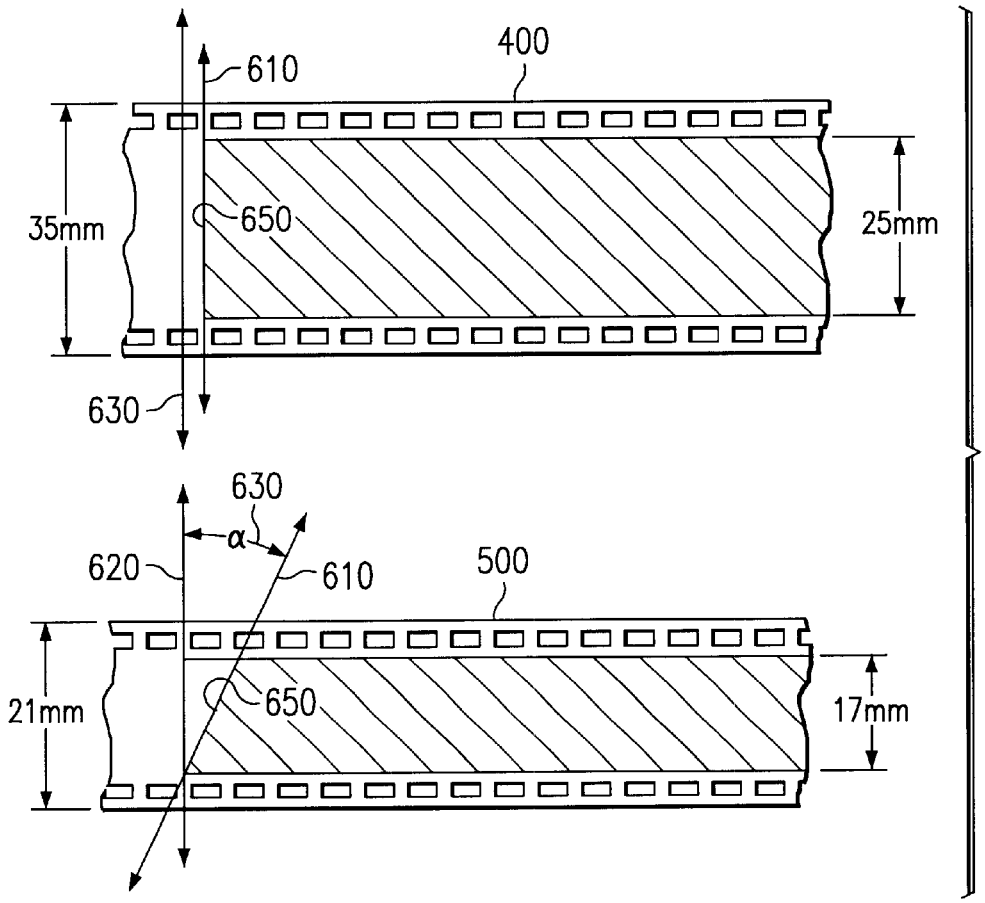
FIG. 6 is a top view of two different sizes of photographic film illustrating two dispensing positions of a coater head according to at least one embodiment of the present invention.

Referring now to FIG. 6, a method of providing a plurality of extrusion widths is illustrated. The method illustrated therein does not require replacement or manual reconfiguration of a system 100 (illustrated in FIG. 1) to produce multiple extrusion widths; instead a coater head is pivoted into a desired dispensing position. For example, suppose developing fluid is dispensed from a slot 650. The point of reference for purposes of this example will be a first imaginary line 620 drawn across the width of film strips 400 and 500. A second imaginary line 610 corresponding to slot 650 is projected onto the plane containing the surface of film strips 400 and 500. In order to extrude the proper width of developing solution onto C135 film 400, system 100 positions slot 650 so that second imaginary line 610 is parallel to first imaginary line 620. As illustrated in FIG. 6, slot 650 is 25 mm long, and will coat film 400 with a 25 mm width of developer—just slightly wider than the minimum 24 mm required by C135 film 400.

To coat APS film 500 with the proper width of developing fluid, slot 650 is pivoted so that second imaginary line 610 forms a non-zero angle $\alpha$ 630 with first imaginary line 620. Basic trigonometry reveals that the magnitude of non-zero angle $\alpha$ 630 necessary to provide a proper extrusion width for APS film 500 is approximately 43° (given a slot width of 25 mm and a desired extrusion width of 17 mm). It follows, therefore, that when slot 650 is pivoted 43° into a second dispensing position, APS film 500 may be processed without requiring replacement of the extruder or coater head.

Similarly, another method of the present invention provides for the positioning of the films 400, 500 at an angle relative to slot 650, where the position of slot 650 is fixed. In this method, films 400, 500 are positioned so that the angle at which slot 650 intercepts films 400, 500 determines the extrusion width. For example, when extruding developing fluid onto C135 film 400, C135 film 400 moves perpendicular to slot 650 (represented by first imaginary line 610), resulting in a developer extrusion width of 25 mm, as discussed previously. However, when extruding developing fluid onto APS film 500, APS film 500 moves (wherein the movement is perpendicular to second imaginary line 620) at a non-zero angle $\alpha$ 630 to slot 650 (imaginary line 610). As discussed previously, angle $\alpha$ 630 necessary to provide a proper extrusion width for APS film 500 is approximately 43° (given a slot width of 25 mm and a desired extrusion width of 17 mm). It follows, therefore, that when APS film 500 is positioned at a 43° angle with respect to slot 650, APS film 500 may be processed without requiring replacement of the extruder or coater head. This method is discussed in greater detail later with reference to FIG. 14. The methods just described can be used for other processes requiring multiple or variable extrusion widths.

One may notice that "positioning a coater head" and "positioning a slot" are used interchangeably within this disclosure. This use is based on a preferred embodiment in which a slot is positioned in fixed relationship to the coater head of which it is a part. In other embodiments of the present invention, the "slot" may move relative to the coater head. In such a case, the coater head may actually be held in a single position, while the "slot" moves. A slot can not in fact move, but instead physical boundaries that define the slot move, and these physical boundaries are within the meaning assigned to the term coater head. Therefore, positioning of a coater head includes, but is not limited to, movement of a "slot" within a coater head. The term "slot" is a preferred manifestation of an applicator opening, and is used throughout the specification for ease of description. It will be appreciated that although a slot is a preferred embodiment, other applicator opening shapes may be used consistent with the spirit and scope of the present invention.

Figure 7:
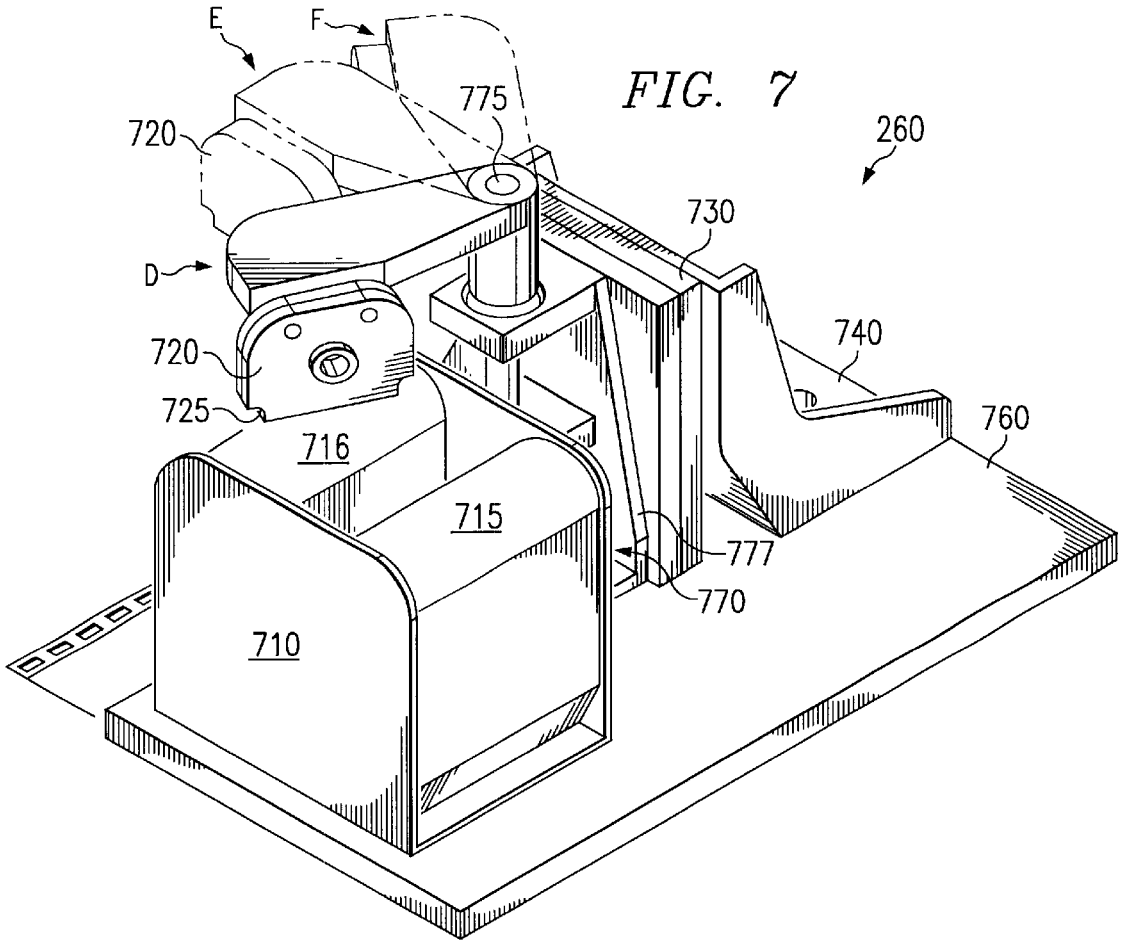
FIG. 7 is a coater head shown pivoting between a non-dispensing position and two different dispensing positions according to at least one embodiment of the present invention.

Having discussed at least one method and system according to the present invention, refer now to FIG. 7, which illustrates an extruder assembly 260 for providing multiple extrusion widths according to the present invention. Extruder assembly 260 comprises wiper/capper assembly 710, which further comprises wiper 716 and cap 715; coater head 720, which includes applicator opening 725 and a fluid entry opening (not shown for ease of illustration); pivot assembly 770, which includes pivot 775, pivot bracket 777, block 730, bracket 740, and base 760.

Base 760 and bracket 740 are used, in one embodiment, to support the remaining elements of extruder assembly 260, and to facilitate mounting of extruder assembly 260 to system 100 (FIG. 1). Block 730 is provided to enable vertical movement of coater head 720. Wiper 716 is preferably configured to just brush the tip of applicator opening 725 as coater head 720 is being moved to a non-dispensing position, and cap 715 is configured to cover applicator opening 725 when coater head 720 is stored in a non-dispensing position. Other capping mechanisms may be employed consistent with the present invention.

Three positions D, E, and F of coater head 720 are shown to illustrate how coater head 720 may pivot between dispensing and non-dispensing positions. Position D shows coater head 720 in the process of being positioned. Position E shows coater head 720 in a first dispensing position. In first dispensing position E, extruder assembly 260 will dispense a width of fluid approximately as wide as applicator opening 725 is long, and in second dispensing position F, coater head 720 will extrude a width of fluid dependent upon the angle of applicator opening 725 in relationship to the material being coated. As mentioned earlier, extruder assembly 260 may be used to dispense a variety of liquids on a variety of materials.

Pivot assembly 770 operates in conjunction with block 730 to move coater head 720 vertically along pivot 775. Depending upon the material being coated and the position of extruder assembly 260, coater head 720 may not need to move up or down, and so block 730 may not be needed. Pivot bracket 777 is preferably used to support pivot 775. Some embodiments of the present invention do not utilize pivot bracket 777. Pivot 775 provides a mechanism that allows coater head 720 to move into dispensing and non-dispensing positions by rotating about a pivot point. Placement of pivot 775 may vary depending upon placement of capping assembly 710, the size of coater head 720, the material being coated, etc.

Coater head 720 also comprises a fluid inlet (not shown). In at least one embodiment of the present invention, fluid to be extruded is pumped through a passage formed in pivot 775. This passage (not shown) is in fluid communication with a fluid inlet formed in coater head 720. The fluid passes through the fluid inlet in coater head 720 and is dispensed through applicator opening 725. External tubes (not shown) may be used to transport the fluid to the fluid inlet if so desired.

Figure 8:
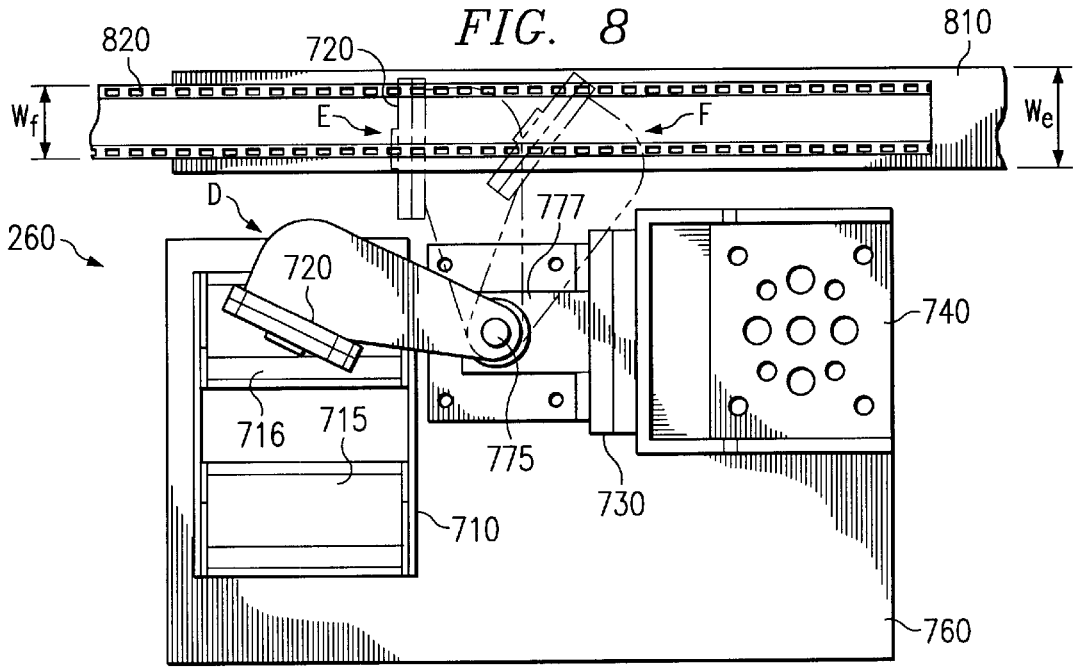
FIG. 8 is a top view of the coater head shown in FIG. 7, and illustrates the two dispensing positions in relation to two portions of material having different sizes, according to at least one embodiment of the present invention.

Referring next to FIG. 8, a top view of extruder assembly 260 is provided to illustrate the different extrusion widths that may be provided by pivoting the coater head 520 according to a preferred embodiment of the present invention. The extruder assembly 260 illustrated in FIG. 8 is the same embodiment as that illustrated in FIG. 7. In addition to extruder assembly 260, however, two portions of material having different widths are shown. First material 810 has a width, $W_E$, corresponding to a first dispensing position E, and second material 820 has a width, $W_F$, corresponding to second dispensing position F. According to at least one embodiment of the present invention, extruder assembly 260 can be used to extrude a width of fluid corresponding to each of the different material widths. It will be appreciated upon examination of FIG. 8 that extruder assembly 260 can just as easily extrude a width of fluid only a fraction of the width of the material being coated, and that extruder assembly 260 could be used with numerous materials of various widths.

Figure 9:
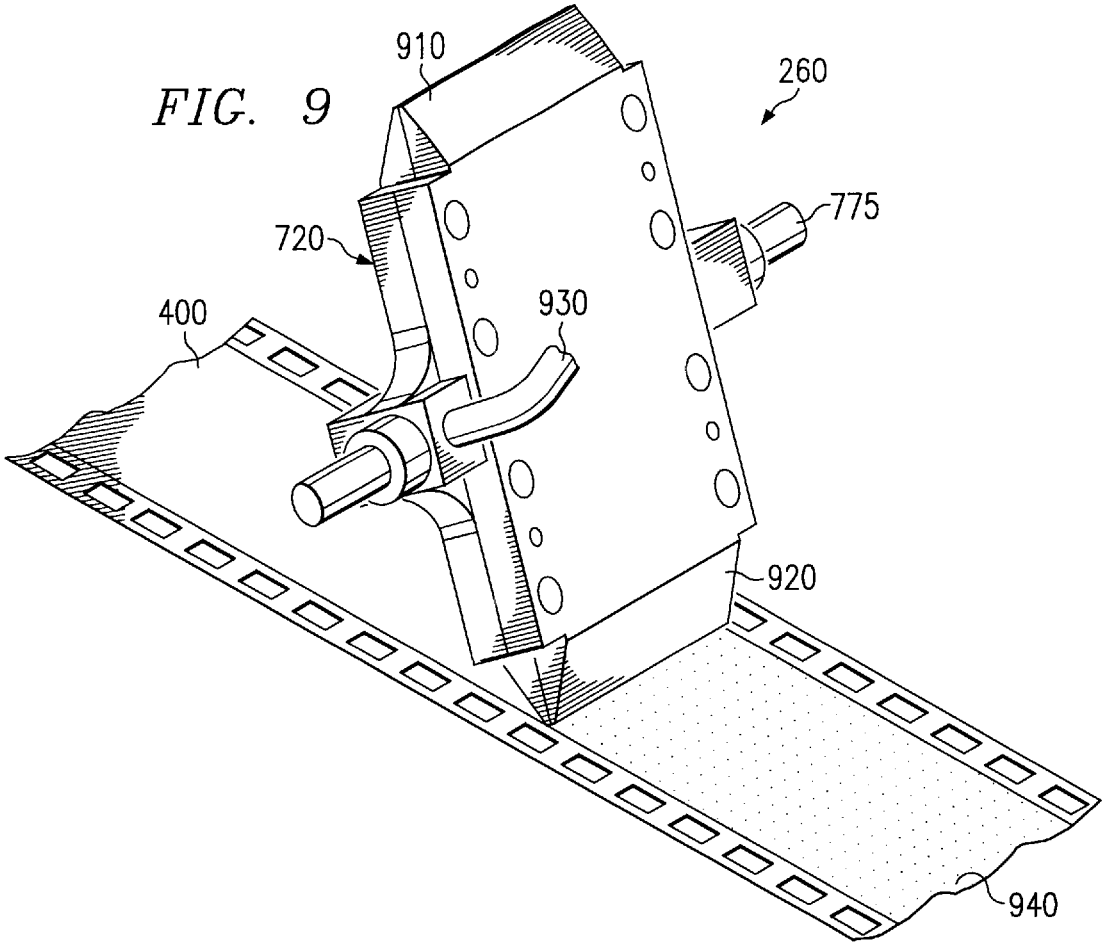
FIG. 9 is a perspective view of a single coater head having dual applicator openings according to at least one embodiment of the present invention.

Referring now to FIG. 9, another embodiment of extruder assembly 260 is shown. In the illustrated embodiment, extruder assembly 260 comprises a single coater head 720, and pivot 775. Coater head 720 comprises fluid inlet 930, and two applicator slots 910 and 920. Coater head 720 may further comprise a valve (not shown). This valve would preferably be internal to coater head 720, and would serve to route fluid to whatever slot was in the dispensing position. Also illustrated in FIG. 9 is C135 film 400 being coated with developer 940.

The two slots shown in FIG. 9 are APS slot 910 and C135 slot 920. Each of the two slots 910 and 920 are configured to extrude a width of developer that is appropriate for coating a particular film type. FIG. 9 shows C135 slot 920 in a dispensing position, and APS slot 910 in a non-dispensing position. To accommodate APS film, a system in which extruder assembly 260 is being employed can rotate coater head 720 about pivot 775 until APS slot 910 is in a dispensing position, and C135 slot 920 is in a non-dispensing position. The valve (not shown) would then be controlled to provide developer 940 to APS slot 910 instead of C135 slot 920. It will be appreciated that although only two different slot sizes are shown, additional slot sizes could be provided to handle various material size configurations, and that even more extrusion widths can be achieved by combining the use of multiple slot sizes and various slot angles, as previously discussed. Additionally, applicator opening configurations other than slots may be used, as discussed previously.

Figure 10:
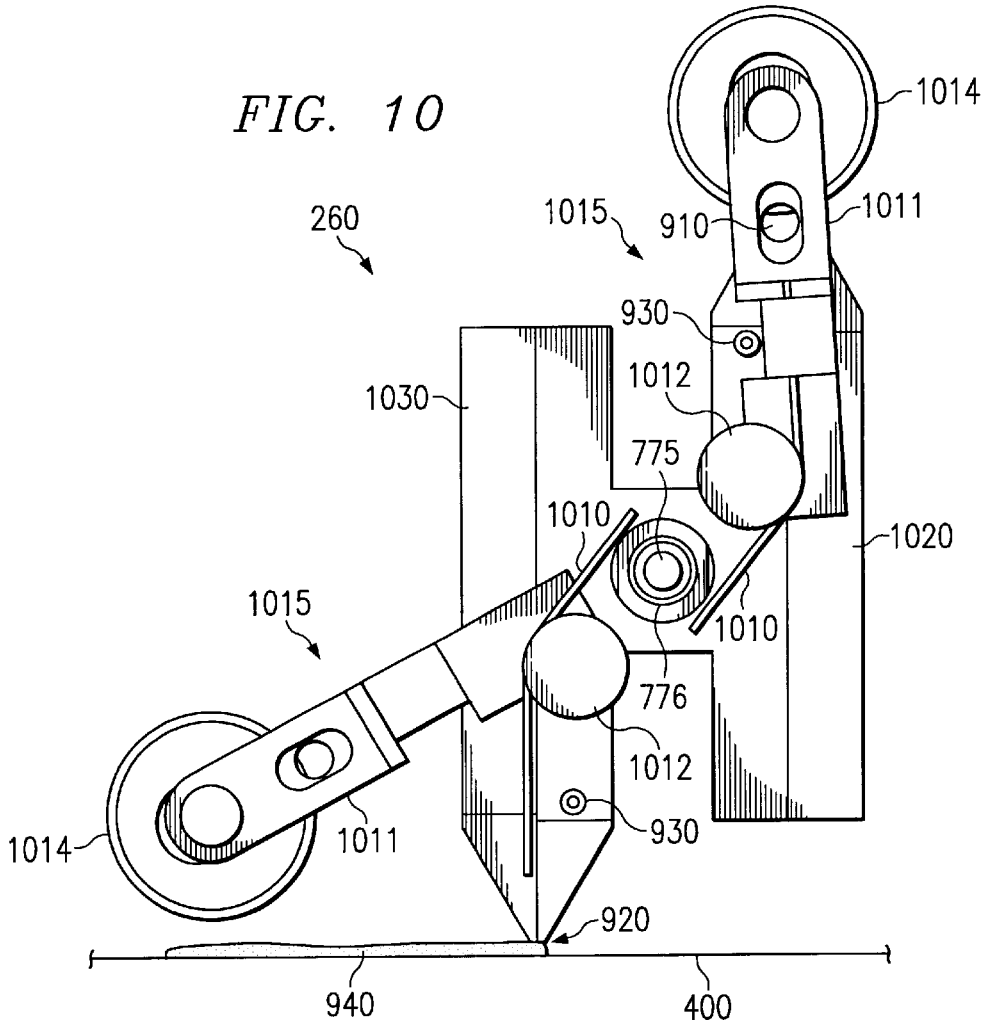
FIG. 10 is a perspective view of an extruder having dual coater heads according to at least one embodiment of the present invention.

Referring next to FIG. 10, an embodiment of extruder assembly 260 that employs two separate coater heads is shown. In the illustrated embodiment, extruder assembly 260 includes capping assemblies 1015, coater heads 1020 and 1030, and pivot 775. Pivot 775 is preferably rotatably supported within bearing sleeve 776, although the use of bearings is not required. Capping assemblies 1015 include rollers 1014, cap brackets 1011, springs 1010, and cap pivots 1012. Coater heads 1020 and 1030 include fluid inlets 930, and slots 910 and 920 respectively.

Extruder assembly 260 rotates about pivot 775 to move either APS head 1020 or C135 head 1030 into dispensing position. Springs 1010 are configured to exert a force on cap brackets 1011, such that rollers 1014 are positioned over slots 910 or 920 in non-dispensing positions. FIG. 10 illustrates APS head 1020 in such a non-dispensing position. When a coater head is moved into a dispensing position, such as that illustrated by C135 head 1030, capping assembly 1015 rotates about cap pivot 1012 so that roller 1014 no longer covers slot 920. Fluid, in this case developer 940, is pumped into C135 head 1030 through fluid inlet 930, and is dispensed from slot 920 onto film 400. Different film sizes may be coated by using pivot 775 to rotate different coater heads into dispensing positions. As noted earlier, although FIG. 10 illustrates a developer extruder for use with photographic film, the present invention finds application in numerous fields where a controlled width of liquid is extruded onto a portion of material.

Figure 11:
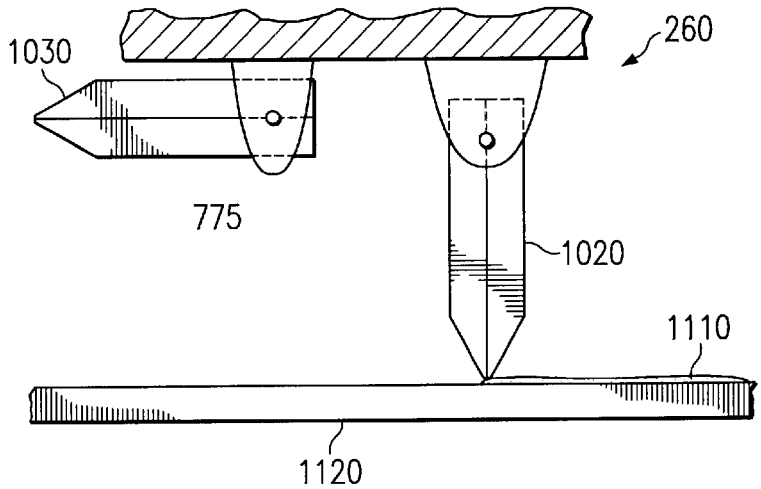
FIG. 11 is a side view of an extruder having dual coater heads according to at least one embodiment of the present invention.

Referring next to FIG. 11, another multiple coater head embodiment of extruder assembly 260 is illustrated. The embodiment of extruder assembly 260 illustrated in FIG. 11 functions in a manner similar to the embodiment illustrated in FIG. 10. The main difference being the way coater heads 1020 and 1030 are moved into and out of dispensing position. The present embodiment does not use a capping mechanism, although it could be modified to do so. In addition, separate pivots 775 are used for each of the coater heads 1020 and 1030. FIG. 11 illustrates the extrusion of adhesive 1110 onto receiving material 1120 by coater head 1020. Coater head 1030 is in a non-dispensing position.

Figure 12:
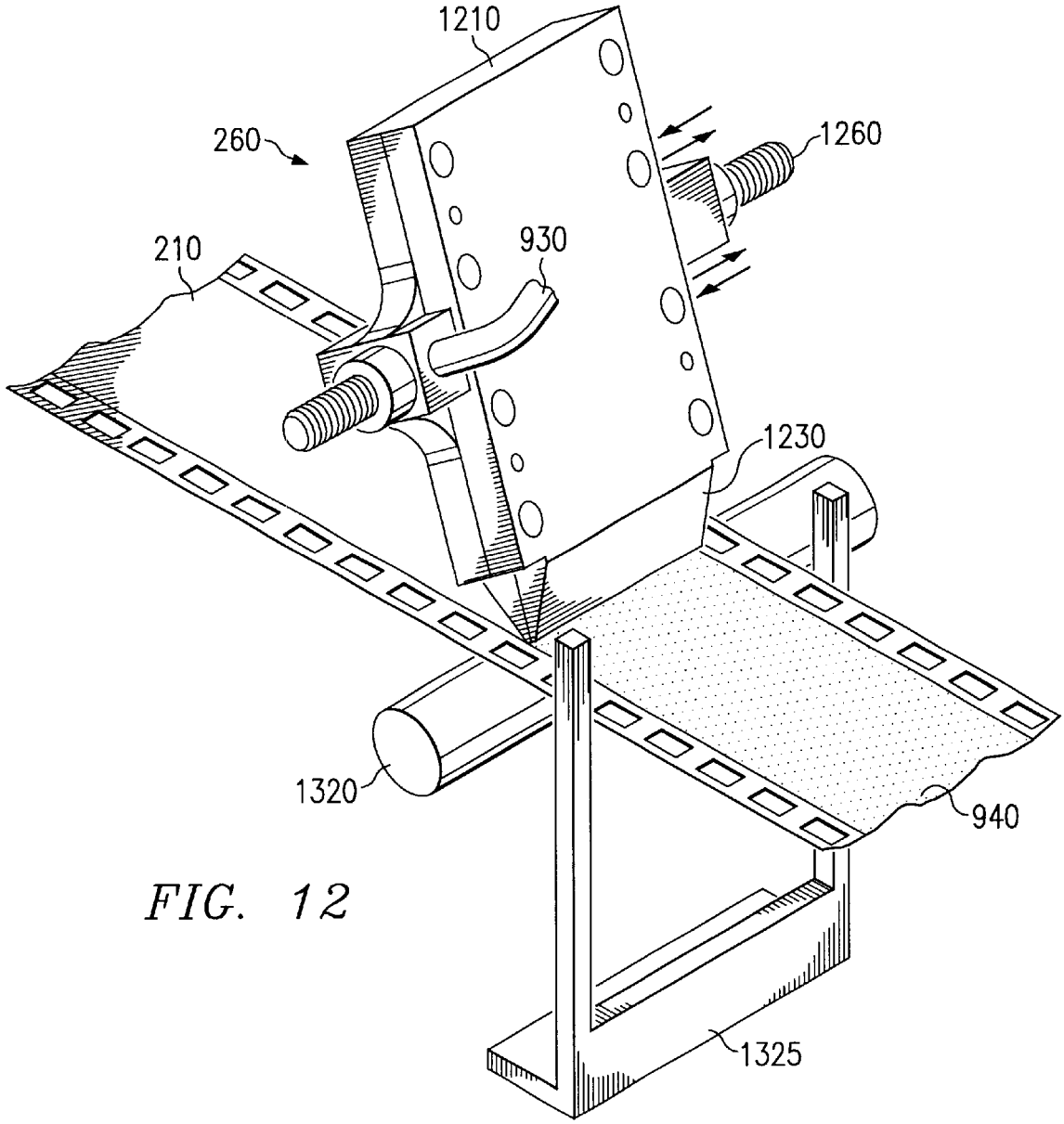
FIG. 12 is a perspective view of an extruder positioned over a strip of film according to at least one embodiment of the present invention.

As discussed previously, multiple extrusion widths maybe applied by altering the angle between the coater head and material being moved past the coater head. In one embodiment, the position of the film with respect to the coater head is rotated to obtain different extrusion widths, as illustrated with reference to FIGS. 12–14. Referring now to FIG. 12, an embodiment of extruder assembly 260 is shown. In the remainder of this discussion, an embodiment of the present invention employing a slot coater is illustrated and discussed. It will be appreciated that application devices such as aerosol applicators or chemical baths may be employed in addition to or in place of a slot coater, and that the discussion is limited primarily to slot coaters for discussion purposes only.

Extruder body 1210 with slot coater 1230, fluid inlet 930 and shaft 1260 are referred to as extruder assembly 260 (shown in FIG. 2). Extruder assembly 260 moves extruder body 1210 along shaft 1260 (in the direction indicated by the arrows) to position slot coater 1230 over a roller, such as web roller 720. Slot coater 1230 receives developer 940 through fluid inlet 930. Using web roller 1320 as a support, slot coater 1230 evenly distributes a desired width of developer 940 onto film 210.

As previously discussed, the fluid being distributed by slot coater head 1230 may be developer940, as illustrated, or another chemical specific to the desired application; the choice of chemical is not specific to the invention. For different film sizes, such as C135 film 400 (FIG. 4) and APS film 500 (FIG. 5), extruder assembly 260 can accommodate multiple extrusion widths by simply moving extruder body 1210, along shaft 1260, into position over a different web roller. Film 210 is positioned in varying angles with respect to slot coater head 1230. How this results in multiple extrusion widths will become clear later in FIGS. 13 and 14; however it should be noted that film 210 may have a tendency to slide and "walk" out of position, when placed at an angle on a roller, such as web roller 1320. While the sliding of film 210 will not affect the coating of film 210, the "walking" can affect the area coated. To keep film 210 in position, guide rail 1325 may be placed in front of or behind web roller 1320. Placing film 210 perpendicular to web roller 1320 will alleviate the "walking" problem; however, web roller 1320 could no longer be used as support for coating film 210 with slot coater head 1230. Alternate film guides include a track mechanism or other types of guard rails. As previously discussed, the track mechanism can be used as a tray to keep film 210 in position before roller 1320, while the guide rails can be placed on the surface of roller 1320. The choice of one film guide over another is left to the user's intended application and is not specific to the invention. Furthermore, other film transport mechanisms may be used in place of web roller 1320, as previously discussed, and the choice of guide apparatus to hold film 210 in position may change accordingly to best fit the transport mechanism.

Figure 13:
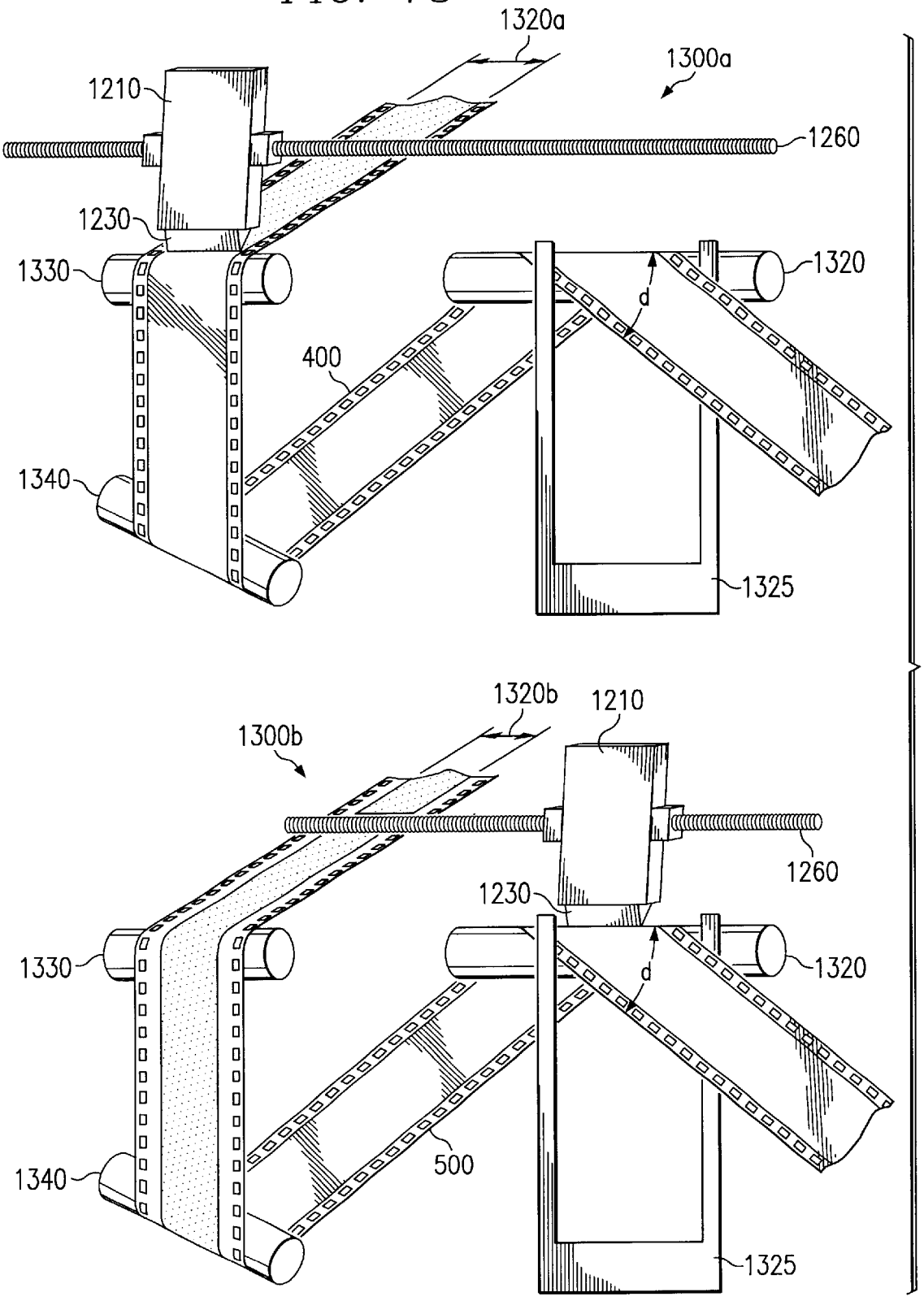
FIG. 13 is a perspective view of a portion of a film transport system according to at least one embodiment of the present invention.

At least one embodiment of the present invention allows for accommodating extrusion widths for C135 film 400, APS film 500, and other film widths by simply moving extruder body 1210 laterally over another roller. Referring now to FIG. 13, such an embodiment is discussed. Two positions of extruder body 1210 are shown, one for developing C 135 film 400, in position 1300*a*, and the other for developing APS film 500, in position 1300*b*. In position 1300*a*, extruder body 1210 is moved laterally, along shaft 1260, into position over C135 film 400. C135 film 400 is guided over web rollers 1320, 1340 and 1330. Since extruder body 1210 is positioned over web roller 1330, it is over web roller 1330 that developer 940, or another desired fluid, is applied to C135 film 400. In one embodiment, web rollers 1340, 1330 guide C135 film 400 so that it is aligned directly with the slot coater head 1230 on extruder body 1210. With a direct alignment, the extrusion width 1220*b* of the developer on C135 film 400 is the full width of slot coater head 1230, as explained further in FIG. 14. In this embodiment, the full width of slot coater head 1230 is chosen to accommodate C135 film 400, making extrusion width 1320*a* (25 mm), just slightly more than the minimum of 24 mm previously shown in FIG. 4.

In one embodiment, the film used in image capturing system 200 is changed from C135 film 400 to APS film 500. To accommodate APS film 500, extruder body 1210 only has to be shifted along shaft 1260, from position 1300*a* to position 1300*b*. In position 1300*b*, extruder body 1210 is positioned directly above APS film 500, over web roller 1320. An extrusion fluid is evenly distributed on APS film 500, through the slot coater head 1230 on extruder body 1210. Since the extrusion width is controlled by the positioning of the film, not the rollers themselves, web rollers 1320 and 1330 can be used for positioning either C135 film 400 or APS film 500, and no replacement of parts is necessary. For example, web roller 1320 guides and positions APS film 500 at an angle $\alpha$ with relation to slot coater head 1230, thereby providing a narrower extrusion width, as described further in FIG. 14. In this embodiment, APS film 500, having already been coated with developer 940, is guided past web rollers 1330 and 1340. Unlike configuration 1300*a*, the extruder is no longer above web roller 1330. Accordingly, no further extrusion fluid is applied to APS film 500 while extruder body 1210 is in position 1300*b*. As previously discussed, when C135 film 400 and APS film 500 are placed at an angle, such as angle $\alpha$, films 400 and 500 may slide and "walk" along web roller 1320; accordingly a guide rail 1325 is placed in front of web roller 1320 to keep APS film 500 and C135 film 400 from shifting out of position.

The illustrated embodiment shows an extruder assembly configured for two types of film, C135 film 400 and APS film 500. However, extruder assembly 260 can be configured for other film types and sizes, as well as other types of materials. The distances, positions, and locations of web rollers 1320, 1330 and 1340 can be preferably adjusted to accommodate multiple film and/or material configurations. In addition, the number of rollers is not limited to web rollers 1320, 1330 and 1340, and others can be added to accommodate any number of configurations. Other film guides, such as guide rail 1325 include film tracks and guard rails. Furthermore, the type of rollers or guides used are not specific to the invention and other transport mechanisms can be used, consistent with the teachings set forth herein.

Figure 14:
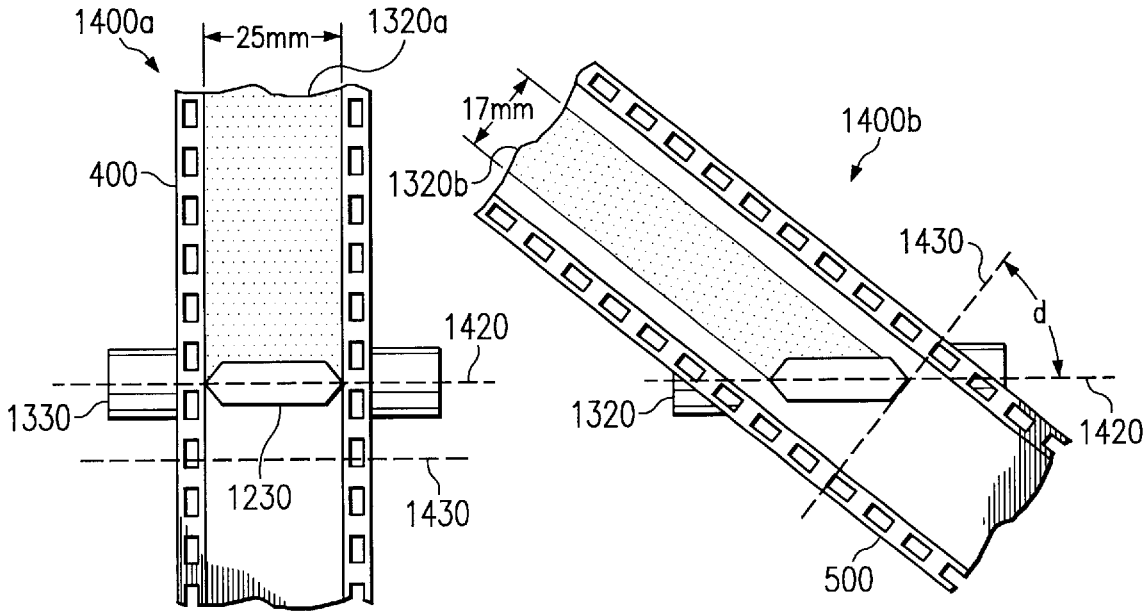
FIG. 14 is a top view illustrating the effect of film positioning on the extrusion fluid width according to at least one embodiment of the present invention.

Referring now to FIG. 14, a top view illustrating the application of different widths of developer on films 400 and 500, according to one embodiment of the present invention, is illustrated. The method illustrated therein does not require replacement of any portion of extruder assembly 260 (FIG. 2) nor manual reconfiguration of image capturing system 200 (FIG. 2) to produce multiple extrusion widths; instead extruder body 1210 (FIG. 12) is simply moved laterally to a different web roller (1320 or 1330), as previously discussed. Films 400 and 500 are positioned differently (positions 1300*a*, 1300*b* respectively), with respect to slot coater head 1230, at web rollers 1330 and 1320. For example, suppose developing fluid is dispensed from slot coater head 1230.

The point of reference for purposes of this example will be a first imaginary line 1430 drawn across the width of film strips 400 and 500. A second imaginary line 1420 corresponding to slot coater head 1230 is projected onto a plane containing the surface of film strips 400 and 500. In order to extrude the proper width of developer 940 (FIG. 9) onto C135 film 400, C135 film 400 is positioned at web roller 1330 so that second imaginary line 1420 is parallel to first imaginary line 1430. As illustrated in FIG. 14, slot coater head 1230 is 25 mm long, and will coat film 400 with a 25 mm extrusion width 1320*a* (just slightly wider than the minimum 24 mm required by C135 film 400).

To coat APS film 500 with the proper extrusion width 1320*b*, APS film 500 is positioned over roller 1320 so that second imaginary line 1420 forms a non-zero angle $\alpha$ with first imaginary line 1430. Basic trigonometry reveals that the magnitude of non-zero angle $\alpha$ necessary to provide a proper extrusion width for APS film 500 is approximately 47° (given slot coater head 1230 with a width of 25 mm and a desired extrusion width 1320*b* of 17 mm). It follows, therefore, that when extruder body 1210 is moved over web roller 1320, APS film 500 may be processed without requiring replacement of the extruder or coater head. As previously discussed, the addition of a film guide, such as guide rail 1325 (FIG. 13) may be necessary to keep film 500 from "walking" out of position over web roller 1320. The method just described can be used for other processes requiring multiple or variable extrusion widths.

In the preceding detailed description, reference has been made to the accompanying drawings which form a part hereof, and in which are shown by way of illustration specific embodiments in which the invention may be practiced. These embodiments have been described in sufficient detail to enable those skilled in the art to practice the invention, and it is to be understood that other embodiments may be utilized and that logical, mechanical, chemical and electrical changes may be made without departing from the spirit or scope of the invention. To avoid detail not necessary to enable those skilled in the art to practice the invention, the description omits certain information known to those skilled in the art. The preceding detailed description is, therefore, not to be taken in a limiting sense, and the scope of the present invention is defined only by the appended claims.

What is claimed is:

1. An extruder for providing a plurality of extrusion widths, said extruder comprising:

at least one coater head, said at least one coater head comprising a fluid entry opening capable of receiving an extrusion fluid, and at least one applicator opening capable of dispensing the extrusion fluid; and wherein said at least one coater head is capable of moving to a plurality of dispensing positions corresponding to the plurality of extrusion widths.

2. The extruder as in claim 1, wherein said coater head is capable of moving to a first dispensing position wherein said at least one coater head is positioned at a first angle, and to a second dispensing position wherein said at least one coater head is positioned at a second angle.

3. The extruder as in claim 1, further comprising a plurality of coater heads having at least one applicator opening capable of dispensing a predetermined width of the extrusion fluid.

4. The extruder as in claim 3, further comprising a first coater head having an applicator opening capable of dispensing a first width of the extrusion fluid in a first dispensing position, and a second coater head having an applicator opening capable of dispensing a second width of the extrusion fluid in a second dispensing position.

5. The extruder as in claim 1, wherein said at least one coater head further comprises a plurality of applicator openings capable of dispensing a predetermined width of the extrusion fluid.

6. The extruder as in claim 5, wherein said at least one coater head comprises a first applicator opening capable of dispensing a first width of the extrusion fluid in a first dispensing position, and a second applicator opening capable of dispensing a second width of the extrusion fluid in a second dispensing position.

7. The extruder as in claim 1, further comprising at least one cap capable of covering said at least one applicator opening to prevent the extrusion fluid from dispensing from said opening.

8. The extruder as in claim 1, further comprising at least one valve capable of controlling dispensing of the extrusion fluid from said applicator opening.

9. An extrusion system comprising:

an extruder having a fluid entry opening capable of receiving an extrusion fluid and an applicator opening capable of dispensing the extrusion fluid;

at least one guide capable of guiding lengths of material having different widths along a predetermined path;

said predetermined path including at least a first point at which a first length of material can be positioned at a first angle relative to said applicator opening;

said predetermined path further including at least a second point at which a second length of material can be positioned at a second angle different from said first angle;

wherein said extruder is capable of being positioned proximate to said at least a first point to dispense extrusion fluid across a desired width of the first length of material; and wherein said extruder is further capable of being positioned proximate to said at least a second point to dispense extrusion fluid across a desired width of the second length of material.

10. The extrusion system as in claim 9, further comprising a plurality of guides.

11. The extrusion system as in claim 9, wherein said at least one guide is a roller.

12. The extrusion system as in claim 11, further comprising:

a plurality of rollers, a first of said plurality of rollers capable of supporting the first length of material at said first point, and a second of said plurality of rollers capable of supporting the second length of material at said second point;

wherein said first point and said second point lie in a plane parallel to said applicator opening; and wherein said extruder is capable of moving laterally within said plane, from one of said first point and said second point to the other of said first point and said second point.

13. The extrusion system as in claim 9, wherein said lengths of material are photographic films, and the extrusion fluid is a fluid used in a photographic development process.

14. The extrusion system as in claim 9, wherein said extrusion system is part of a digital film processing system.

15. The extrusion system as in claim 9, further comprising a cap capable of preventing the extrusion fluid from dispensing from said applicator opening.

16. The method as in claim 9, further comprising a valve capable of controlling dispensing of the extrusion fluid from said applicator opening.

17. A method for providing a plurality of extrusion widths, said method comprising:

providing an extruder, the extruder comprising at least one coater head, and wherein the coater head comprises a fluid entry opening capable of receiving an extrusion fluid and at least one applicator opening capable of dispensing the extrusion fluid; and positioning the at least one coater head in a plurality of dispensing positions corresponding to the plurality of extrusion widths.

18. The method as in claim 17, comprising:

positioning the at least one coater head at a first angle corresponding to a first dispensing position; and positioning the at least one coater head at a second angle corresponding to a second dispensing position.

19. The method as in claim 17, wherein the extruder comprises a plurality of coater heads having at least one applicator opening capable of dispensing a predetermined width of the extrusion fluid.

20. The method as in claim 19, wherein the extruder further comprises a first coater head having an applicator opening capable of dispensing a first width of the extrusion fluid, and a second coater head having an applicator opening capable of dispensing a second width of the extrusion fluid; and wherein the method further comprises:

positioning the first coater head in a first dispensing position;

dispensing the first width of extrusion fluid from the first coater head; positioning the second coater head in a second dispensing position; and dispensing the second width of extrusion fluid from the second coater head.

21. The method as in claim 17, wherein the at least one coater head further comprises a plurality of applicator openings capable of dispensing a predetermined width of the extrusion fluid.

22. The method as in claim 21, wherein the at least one coater head comprises a first applicator opening capable of dispensing a first width of the extrusion fluid in a first dispensing position, and a second applicator opening capable of dispensing a second width of the extrusion fluid in a second dispensing position; and wherein the method further comprises:

positioning the at least one coater head in a first dispensing position;

dispensing the first width of extrusion fluid from the first applicator opening;

positioning the at least one coater head in a second dispensing position; and dispensing the second width of extrusion fluid from the second applicator opening.

23. The method as in claim 17, further comprising covering the at least one applicator opening with a cap to prevent the extrusion fluid from dispensing from the opening.

24. The method as in claim l7, further comprising activating a valve to control dispensing of the extrusion fluid from the applicator opening.

25. A method for providing a plurality of extrusion widths, said method comprising:

providing an extruder having a fluid entry opening capable of receiving an extrusion fluid and an applicator opening capable of dispensing the extrusion fluid;

guiding a first length of material having a first width along a predetermined path, such that at least a portion of the first length of material is positioned at a first angle relative to the applicator opening;

positioning the extruder proximate to the at least a portion of the first length of material positioned at a first angle relative to the applicator opening;

dispensing the extrusion fluid across a desired width of the first length of material;

guiding a second length of material having a second width along a predetermined path, such that at least a portion of the second length of material is positioned at a second angle, different from the first angle, relative to the applicator opening;

positioning the extruder proximate to the at least a portion of the second length of material positioned at a second angle relative to the applicator opening; and dispensing the extrusion fluid across a desired width of the second length of material.

26. The method as in claim 25, wherein:

lengths of material are guided using a plurality of rollers, a first of the plurality of rollers capable of supporting the at least a portion of the first length of material positioned at the first angle, and a second of the plurality of rollers capable of supporting the at least a portion of the second length of material positioned at the second angle;

wherein the first of the plurality of rollers and the second of the plurality of rollers lie in a plane parallel to the applicator opening; and wherein positioning the extruder includes moving the extruder laterally within the plane.

27. The method as in claim 25, wherein the extrusion fluid is a fluid used in a photographic development process.

28. The method as in claim 25, wherein the method is implemented in a digital film processing system.

29. The method as in claim 25, further comprising covering the at least one applicator opening with a cap to prevent the extrusion fluid from dispensing from the opening.

30. The method as in claim 25, further comprising activating a valve to control dispensing of the extrusion fluid from the applicator opening.

31. A system comprising:

an extruder comprising at least one coater head, said at least one coater head comprising a fluid entry opening capable of receiving an extrusion fluid, and at least one applicator opening capable of dispensing the extrusion fluid, and wherein said at least one coater head is capable of moving to a plurality of dispensing positions corresponding to the plurality of extrusion widths; and an apparatus capable of moving a material through said system such that the material is positioned, for a period of time, to receive the extrusion fluid dispensed from said applicator opening.

32. The system as in claim 31, wherein said coater head is capable of moving to a first dispensing position wherein said at least one coater head is positioned at a first angle, and to a second dispensing position wherein said at least one coater head is positioned at a second angle.

33. The system as in claim 31, further comprising a plurality of coater heads having at least one applicator opening capable of dispensing a predetermined width of the extrusion fluid.

34. The system as in claim 33, wherein said extruder further comprises a first coater head having an applicator opening capable of dispensing a first width of the extrusion fluid in a first dispensing position, and a second coater head having an applicator opening capable of dispensing a second width of the extrusion fluid in a second dispensing position.

35. The system as in claim 31, wherein said at least one coater head further comprises a plurality of applicator openings capable of dispensing a predetermined width of the extrusion fluid.

36. The system as in claim 35, wherein said at least one coater head comprises a first applicator opening capable of dispensing a first width of the extrusion fluid in a first dispensing position, and a second applicator opening capable of dispensing a second width of the extrusion fluid in a second dispensing position.

37. The system as in claim 31, wherein said extruder further comprises at least one cap capable of covering said at least one applicator opening to prevent the extrusion fluid from dispensing from said opening.

38. The system as in claim 31, wherein said extruder further comprises at least one valve capable of controlling dispensing of the extrusion fluid from said applicator opening.

39. The system as in claim 31, wherein said system is a film processing system, said material is film and said extrusion fluid is a developer.

40. A film processing system comprising:

at least one illumination source;

at least one light sensitive detector capable of generating electronic representations of images formed in a photographic film;

an extruder having a fluid entry opening capable of receiving an extrusion fluid and an applicator opening capable of dispensing the extrusion fluid;

a film transport system comprising at least one guide capable of guiding films having different widths along a predetermined path;

said predetermined path including:

at least a first point at which a first film can be positioned at a first angle relative to said applicator opening;

at least a second point at which a second film can be positioned at a second angle different from said first angle; said predetermined path further including at least a third point at which a film is capable of being positioned such that said illumination source illuminates the positioned film, and said detector generates corresponding electronic images; and wherein said extruder is capable of being positioned proximate to said at least a first point to dispense extrusion fluid across a desired width of the first film, and proximate to said at least a second point to dispense extrusion fluid across a desired width of the second film.

41. The film processing system as in claim 40, wherein said film transport system further comprises a plurality of guides.

42. The film processing system as in claim 40, wherein said at least one guide is a roller.

43. The film processing system as in claim 40, wherein said transport system further comprises:

a plurality of rollers, a first of said plurality of rollers capable of supporting the first film at said first point, and a second of said plurality of rollers capable of supporting the second film at said second point;

wherein said first point and said second point lie in a plane parallel to said applicator opening; and wherein said extruder is capable of moving laterally within said plane, from one of said first point and said second point to the other of said first point and said second point.

44. The film processing system as in claim 40, wherein:

said at least one illumination source is capable of providing infrared illumination;

said at least one detector is sensitive to infrared illumination; and wherein said film transport system, said extruder, said at least one illumination source, and said at least one detector cooperate to capture images at different times during a film's development.

45. The film processing system as in claim 40, wherein the photographic film is a digital film processing specific film.

* * * * *